US008037633B1

(12) United States Patent
Troy

(10) Patent No.: US 8,037,633 B1
(45) Date of Patent: Oct. 18, 2011

(54) HANDGUARD SYSTEM FOR FIREARMS

(76) Inventor: Stephen P. Troy, Lee, MA (US)

( * ) Notice: Subject to any disclaimer, the term of this patent is extended or adjusted under 35 U.S.C. 154(b) by 75 days.

(21) Appl. No.: 12/389,732

(22) Filed: Feb. 20, 2009

(51) Int. Cl.
*F41C 23/00* (2006.01)

(52) U.S. Cl. ..... 42/71.01; 42/75.02; 42/75.01

(58) Field of Classification Search ..... 42/71.01, 42/75.01, 75.02
See application file for complete search history.

(56) References Cited

U.S. PATENT DOCUMENTS

| | | | | |
|---|---|---|---|---|
| 3,090,150 | A | 5/1963 | Stoner | |
| 5,343,650 | A | 9/1994 | Swan | |
| 5,590,484 | A * | 1/1997 | Mooney et al. | 42/111 |
| 6,490,822 | B1 | 12/2002 | Swan | |
| 6,671,990 | B1 * | 1/2004 | Booth | 42/75.01 |
| 6,694,660 | B1 | 2/2004 | Davies | |
| 6,779,288 | B1 * | 8/2004 | Kim | 42/72 |
| 6,895,708 | B2 * | 5/2005 | Kim et al. | 42/72 |
| 7,059,076 | B2 * | 6/2006 | Stoner et al. | 42/75.01 |
| 7,216,451 | B1 * | 5/2007 | Troy | 42/72 |
| 7,707,762 | B1 * | 5/2010 | Swan | 42/85 |
| 2006/0010748 | A1 * | 1/2006 | Stoner et al. | 42/71.01 |

* cited by examiner

*Primary Examiner* — Michael Carone
*Assistant Examiner* — Samir Abdosh
(74) *Attorney, Agent, or Firm* — Parsons & Goltry; Robert A. Parsons; Michael W. Goltry

(57) ABSTRACT

A handguard used on a firearm with a barrel nut having tines spaced about the outer periphery. The handguard includes a tubular body in which the inner surface adjacent the proximal end has a diameter larger than an outer diameter of the barrel nut and smaller than a diameter defined by the outer tips of the tines. Grooves are defined in the inner surface and extend longitudinally from the proximal end toward the distal end. The grooves are spaced apart around the periphery so as to correspond with the tines on the barrel nut. The body further has a circumferentially extending channel in the inner surface, spaced from the proximal end so as to receive the tines therein with the barrel nut in the tightened position to allow limited rotation of the body around the barrel relative to the barrel nut until the tines are aligned behind lands between the grooves.

20 Claims, 3 Drawing Sheets

FIG. 7
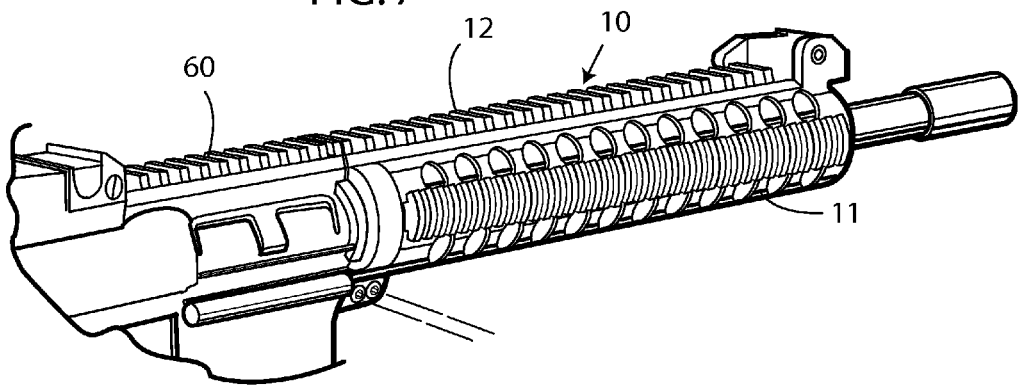
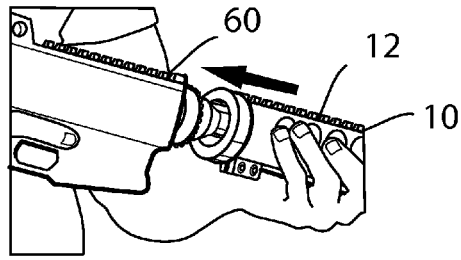
FIG. 8
FIG. 9
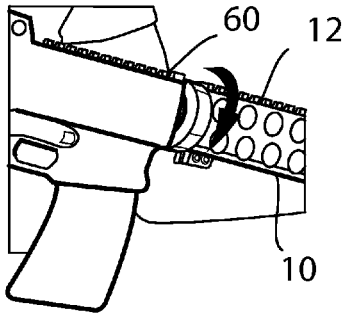
FIG. 10
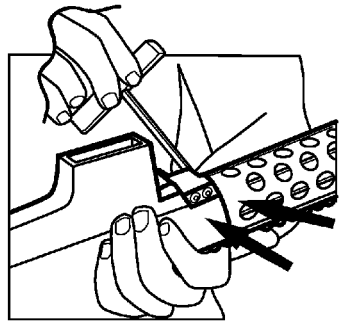

HANDGUARD SYSTEM FOR FIREARMS

FIELD OF THE INVENTION

This invention relates to a handguard for firearms.

More particularly, the present invention relates to a handguard that is mounted and supported by the barrel nut of a firearm.

BACKGROUND OF THE INVENTION

It is understood that hand-held firearms require some type of handguard so that the operator can hold the firearm without coming in contact with the barrel. Also, many accessories are available that aid in the proper and/or enhanced operation of firearms and some type of platform or mounting structure is generally provided or available as an accessory for this function. Several problems are prevalent in the firearms industry with respect to hand guards or hand grips and rail assemblies. Many firearms are operated as automatic or semiautomatic and have a tendency to heat extensively so that handgrips attached directly to the barrel can produce hand burns for the operator if great care is not taken. Also, many of the accessories available for aiding in the proper and/or enhanced operation of a firearm must be physically separated from the barrel so they do not overheat.

Several handguards are disclosed in the prior art that are attached to the barrel nut and are also supported by a rail attached to the upper portion of the firearm receiver. Generally, these handguards are relatively complicated to manufacture and require at least some dismantling of the firearm to mount the handguard. Because of the complexity, these prior art handguards are expensive and include many parts that can be broken, lost, bent, or otherwise cause the handguard to become unworkable. Also, much time and effort is required in the mounting or dismounting, of the handguard for maintenance, etc. of the forearm.

It would be highly advantageous, therefore, to remedy the foregoing and other deficiencies inherent in the prior art.

Accordingly, it is an object the present invention to provide a new and improved handguard for firearms.

SUMMARY OF THE INVENTION

Briefly, to achieve the desired objects of the present invention in accordance with a preferred embodiment, provided is a handguard for use on a firearm having a receiver, a barrel and a barrel nut affixing the barrel to the receiver. As understood in the art, the barrel nut has radially outwardly directed tines spaced about the outer periphery. The handguard includes an elongated tubular, cylindrical body with an inner surface and an outer surface with a distal end and a proximal end. The inner surface of the body adjacent the proximal end has a diameter larger than an outer diameter of the barrel nut and smaller than a diameter defined by the outer tips of the tines. The body has a plurality of radially outwardly directed grooves defined in the inner surface and extending longitudinally from the proximal end toward the distal end. The grooves are spaced apart around the periphery of the inner surface so as to correspond with the tines on the barrel nut, one groove for each tine. As will be understood, the grooves define a longitudinally extending land between each adjacent pair of grooves. The body further has a circumferentially extending channel defined in the inner surface, spaced from the proximal end so as to receive the tines therein with the barrel nut in the tightened position to allow limited rotation of the body around the barrel relative to the barrel nut.

The desired objects of the present invention are further realized in accordance with a specific embodiment thereof in which the handguard is positioned on a firearm having a receiver, a barrel and a barrel nut affixing the barrel to the front end of the receiver. The barrel nut has radially outwardly directed tines spaced about the outer periphery. The handguard includes an elongated tubular, cylindrical body with an inner surface and an outer surface and a distal end and a proximal end. The inner surface of the body adjacent the proximal end has a diameter larger than an outer diameter of the barrel nut and smaller than a diameter defined by the outer tips of the tines. A plurality of longitudinally extending mounting rails is distributed around the outer periphery of the body with the rails being formed to mount auxiliary equipment on the firearm in a well known manner. The body has a plurality of radially outwardly directed grooves defined in the inner surface and extending longitudinally from the proximal end toward the distal end. The grooves are spaced apart around the periphery of the inner surface so as to correspond with the tines on the barrel nut, one groove for each tine. The grooves define a longitudinally extending land between each adjacent pair of grooves. The body further has a circumferentially extending channel defined in the inner surface, spaced from the proximal end so as to receive the tines therein with the barrel nut in the tightened position to allow limited rotation of the body around the barrel relative to the barrel nut. The body is substantially coaxially positioned around the barrel with the proximal end adjacent the front end of the firearm receiver and the tines of the barrel nut positioned in the channel and aligned, one each, with the lands between each adjacent pair of grooves and a mounting rail on an upper surface of the body axially aligned with a mounting rail on the upper surface of the firearm receiver. A pair of opposed generally arcuate fingers associated with the body are positioned adjacent the proximate end and pressure apparatus clamps the opposed arcuate fingers together against the barrel nut to fixedly engage the handguard with the barrel nut.

The desired objects of the present invention are further realized in accordance with a specific method in which the handguard is positioned on a firearm having a receiver, a barrel and a barrel nut affixing the barrel to the receiver. The barrel nut having radially outwardly directed tines spaced about the outer periphery and the firearm further having a mounting rail extending axially along the upper surface of the receiver. The method includes the step of providing a handguard having an elongated tubular, cylindrical body with an inner surface and an outer surface, the body having a distal end and a proximal end, the body having a mounting rail extending longitudinally along the upper surface, the inner surface of the body adjacent the proximal end having a diameter larger than an outer diameter of the barrel nut and smaller than a diameter defined by the outer tips of the tines, the body having a plurality of radially outwardly directed grooves defined in the inner surface and extending longitudinally from the proximal end toward the distal end, the grooves being spaced apart around the periphery of the inner surface so as to correspond with the tines on the barrel nut, one groove for each tine, the grooves defining a longitudinally extending land between each adjacent pair of grooves, and the body further having a circumferentially extending channel defined in the inner surface, spaced from the proximal end so as to receive the tines therein with the barrel nut in the tightened position to allow limited rotation of the body around the barrel relative to the barrel nut. The method further includes the steps of engaging the body of the handguard substantially coaxially over the barrel of the firearm with the proximal end adjacent the front surface of the firearm receiver, positioning the body of the handguard with the plurality of radially outwardly directed grooves aligned with the tines of the barrel nut and rotationally offset at least one tine so the mounting rail on the upper surface of the body is misaligned at least one tine from the mounting rail on the upper surface of the firearm receiver, moving the body of the handguard longitudinally to receive the tines of the barrel nut in the grooves far enough to be rotationally aligned with the circumferentially extending channel, and rotating the body of the handguard until the mounting rail on the upper surface of the body is aligned with the mounting rail on the upper surface of the firearm receiver and the tines on the barrel nut are aligned with the lands between each adjacent pair of grooves.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which:

FIG. 7 is a side perspective view of the handguard of FIG. 1 assembled on a firearm; and FIGS. 8, 9, and 10 are a series of perspective views illustrating steps in assembling or mounting the handguard on a firearm.

DETAILED DESCRIPTION OF A PREFERRED EMBODIMENT

Figure 1:
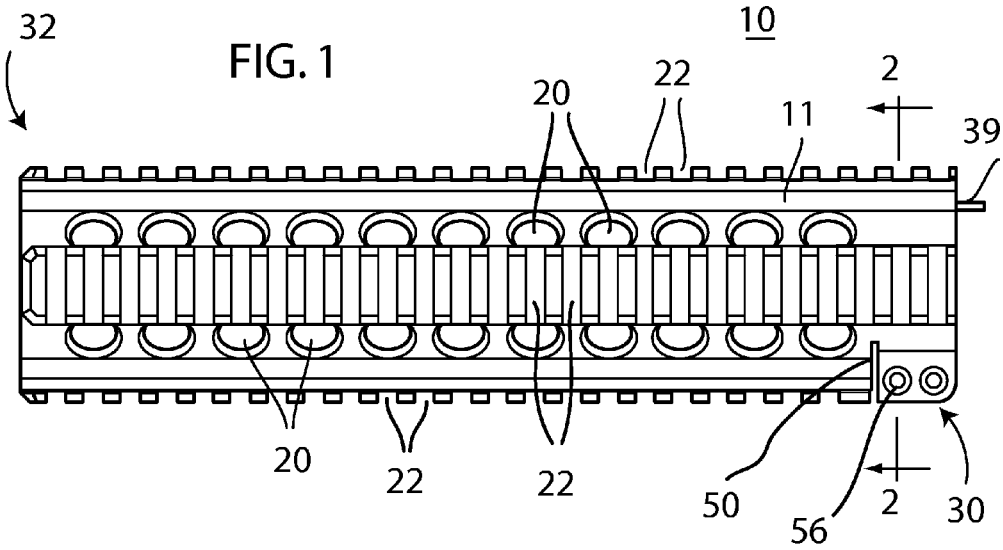
FIG. 1 is a side view of a handguard for a firearm in accordance with the present invention.
Figure 2:
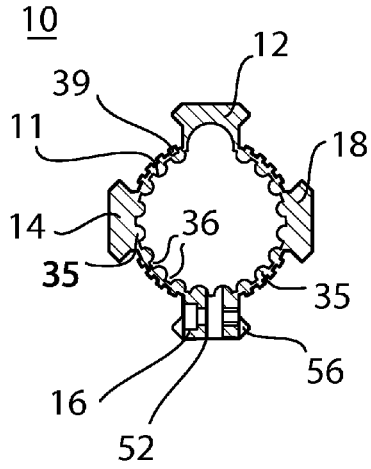
FIG. 2 is an end view of the handguard of FIG. 1, from the right end thereof.

Turning now to the drawings, attention is directed to FIGS. 1 and 2 which illustrate an embodiment of a handguard, designated 10, in accordance with the present invention. In this specific embodiment, handguard 10 includes an elongated tubularly shaped, cylindrical body 11 with a generally round cross-section. It will of course be understood that the cross-section could be oval, square, rectangular, or any cylindrical configuration but primarily is hollow or tubular so as to surround at least a portion of the barrel of a firearm without coming in contact therewith along the length of the barrel that is surrounded. For reasons that will become apparent presently, a handguard with a round cross-section is preferred because it is the simplest to form and manufacture. Generally, the inner diameter of body 11, at least adjacent the proximal end, is slightly larger than the outer diameter of the barrel nut for reasons that will be described in more detail below. Also, the length of body 11 of handguard 10 is such that, when mounted on a firearm, it extends from the front surface of the upper receiver of the firearm to a distance short of the end of the barrel for easy and convenient gripping by a user and protection of the user's hand from the barrel.

A plurality of ribs or mounting rails 12, 14, 16, and 18 are distributed around the outer periphery of body 11 to provide support and mounting apparatus for various accessories that a user may want to affix thereto. In this embodiment each of the ribs or mounting rails 12, 14, 16, and 18 extend the length of body 11 and are formed with a 'dovetail' cross-section as commonly used in the field to mount accessories, although other forms may be utilized if desired. Also, in this specific embodiment four ribs or mounting rails 12, 14, 16, and 18 are included, one each at the top, bottom, and opposed sides, for convenience in mounting virtually any of the various accessories presently available. Further, as will be explained in more detail presently, handguard 10 is mounted in a generally cantilevered configuration and the four ribs or mounting rails provide additional stiffness or support.

Further, in this preferred embodiment the entire handguard 10 is formed as a single piece and can be manufactured from some convenient material, such as a metal (aluminum, light steel, etc.), for example, by extruding or the like. Holes 20 are formed in the space between ribs or mounting rails 12, 14, 16, and 18 in a regularly spaced pattern along the length of body 11 to allow heat from the firearm barrel to escape and to lighten the overall weight of handguard 10. Also the outer surface of each of ribs or mounting rails 12, 14, 16, and 18 include lateral grooves 22 to enhance the mounting of some accessories, as will be understood by those skilled in the art, and to further reduce the overall weight.

As illustrated in FIG. 1, handguard 10 has a mounting or proximal end 30 and a cantilevered or distal end 32. The internal or mounting surfaces of handguard 10 as they are formed within proximal end 30 are illustrated in FIG. 2 and the broken-away view of FIG. 3 and FIG. 4. Turning first to FIG. 2, it can be seen that the inner surface of handguard 10 is formed with a plurality of radially outwardly directed grooves 36 distributed around the inner periphery and extending longitudinally along the inner periphery. As will be understood, a land 35 is formed between each pair of grooves 36. Depending upon the process used to form handguard 10, grooves 36 may extend partially along the length or completely along the length of body 11. For example, if an extrusion process is used grooves 36 are formed to extend the entire length of body 11 and would further reduce the overall weight of handguard 10.

Figure 5:
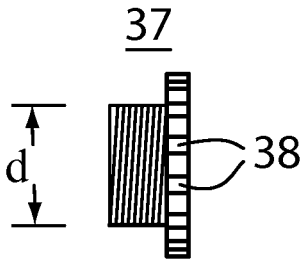
FIG. 5 is a side view of a typical barrel nut used in firearms of the type contemplated herein.
Figure 6:
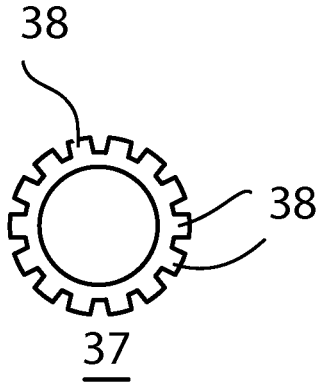
FIG. 6 is an end view of the barrel nut of FIG. 5.

Turning briefly to FIGS. 5 and 6, side and end views are illustrated, respectively, of a typical barrel nut 37 used in various firearms to affix the barrel in position in the front end of a receiver. As understood by one skilled in the art, barrel nut 37 has an outer diameter (periphery), designated 'd' in FIG. 5, and includes a plurality of regularly spaced tines 38, extending radially outwardly from the outer periphery at the outer or front end. Tines 38 are provided to allow the application of a tool (spanner wrench) for inserting/tightening and removing/loosening barrel nut 37 into and out of the firearm. To provide space for the proper application of the tool, barrel nut 37 is constructed to be positioned so that when in the installed or tightened position, tines 38 are spaced slightly from the front surface of the firearm receiver.

Turning again to FIG. 2, it can be seen that the number and position or spacing of grooves 36 correspond with tines 38 adjacent the front surface of barrel nut 37. Also, as stated above, the inner diameter of body 11, at least adjacent proximal end 30, is slightly larger than the outer diameter 'd' of barrel nut 37 and smaller than a diameter defined by the outer tips or ends of tines 38. Thus, handguard 10 is positioned so that all of the tines 38 correspond with all of the grooves 36, one tine 38 per one groove 36. Further, because tines 38 are spaced slightly in front of the front surface of the firearm receiver, when handguard 10 is moved longitudinally along the firearm so that the surface of proximal end 30 is butting against the front surface of the firearm receiver, tines 38 are recessed into grooves 36 a short distance.

Figure 3:
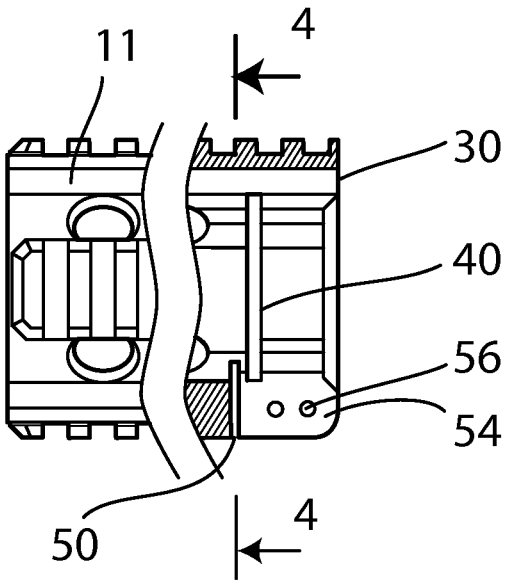
FIG. 3 is a partially side view of the handguard of FIG. 1, portions thereof removed and shown in section to illustrate details of the inner construction.
Figure 4:
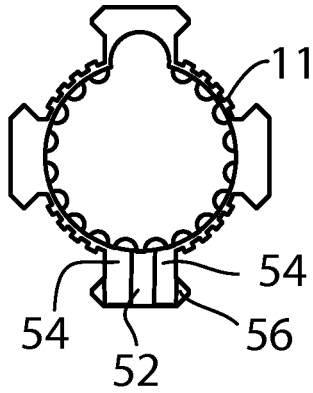
FIG. 4 is a view of the handguard as seen from the line 4-4 of FIG. 3.

Referring specifically to FIG. 3, it can be seen that a circumferentially extending groove or trench 40 is formed in the inner surface of handguard 10 a short distance from proximal end 30. As an example, in this specific embodiment groove 40 is approximately 0.125 inches across (width) and approximately 0.75 inches from proximal end 30. The width of groove 40 is slightly larger than the longitudinal width of tines 38 and the depth is approximately equal to the length of tines 38. Also, the distance groove 40 is positioned from the surface of proximal end 30 is approximately the distance between tines 38 and the front surface of the receiver when barrel nut 37 is fully tightened into the operating position. Thus, once handguard 10 is butting against the front surface of the receiver, tines 38 of the barrel nut will be approximately circumferentially aligned with groove 40. A slight twisting or limited rotational movement of handguard 10 will misalign tines 38 from grooves 36 and place the tines behind lands 35 between grooves 36. Optionally, handguard 10 can be constructed so that there is a slight frictional engagement between tines 38 and lands 35, so as to lock handguard 10 in the desired position. Also, some mechanism or stop (e.g. pin 39) can be included on one or both of the outer or inner surfaces to limit the rotational movement as, for example, once upper rib or mounting rail 12 is aligned with the mounting rail on the upper side of the receiver further rotation is prevented. Pin 39 can extend longitudinally rearward and engage a portion of the firearm when handguard 10 is in the desired (locked) position.

To ensure that handguard 10 is firmly locked in position and cannot come loose, in the preferred embodiment an arcuate cut 50 is provided through the lower rib or mounting rail 16 into groove 40. In this preferred embodiment cut 50 extends partially around the periphery and, for example, stops short of side ribs or mounting rails 14 and 18. A second radially extending cut 52 is formed through approximately the center of lower rib or mounting rail 16 and extends from the proximal end into groove 40. Thus, a pair of slightly flexible, slightly spaced apart opposed arcuate fingers 54 are formed at the proximal end of handguard 10. In this preferred embodiment a pair of set screws 56 are positioned to extend through one finger 54 and to be threadedly engaged in the opposed finger 54. Thus, tightening set screws 56 forces fingers 54 together and tightly locks handguard 10 onto barrel nut 37. It will be understood that set screws 56 are one type of pressure apparatus for clamping arcuate fingers 54 around barrel nut 37 and various other apparatus might be employed. FIG. 7 is a side perspective view of handguard 10 assembled on a firearm.

Turning to FIGS. 8, 9, and 10 a serious of perspective views illustrate steps in assembling or mounting handguard 10 on a firearm. As illustrated in FIG. 8, handguard 10 is moved generally coaxially into a surrounding orientation with the barrel of the firearm. As illustrated in FIG. 9, handguard 10 is moved into abutting engagement with the front surface of the receiver of the firearm with upper rib or mounting rail 12 slightly misaligned with the mounting rail, designated 60, on the upper side of the receiver. Generally, this misalignment will be, for example, one tine 38 on barrel nut 37. Handguard 10 is then twisted or rotated until upper rib or mounting rail 12 is axially aligned with mounting rail 60. In this position, tines 38 on barrel nut 37 are positioned in groove 40 and each tine 38 is oriented behind one of the lands 35. Thus handguard 10 is now locked into the operating position, illustrated in FIG. 7. To ensure that handguard 10 remains in this position, the pair of set screws 56 are tightened, as illustrated in FIG. 10, so that arcuate arms 54 fixedly grip barrel nut 37 and prevent any relative movement.

Thus, a new and improved handguard has been disclosed. The novel handguard can be utilized with existing firearms and includes a number of advantages in construction and operation including but not limited to simple construction and easily manufactured, and simple and highly versatile to use. As illustrated in FIGS. 8, 9, and 10, the novel handguard can be quickly and easily assembled onto a firearm without the need to dismantle or otherwise render the firearm inoperable. Further, the novel handguard is spaced from the barrel so that the operator's hands or the handguard are not in contact with the barrel during use.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

The invention claimed is:

1. A handguard for use on a firearm having a receiver, a barrel and a barrel nut affixing the barrel to the receiver, the barrel nut having radially outwardly directed tines spaced about the outer periphery, the handguard comprising:

an elongated tubular, cylindrical body with an inner surface and an outer surface, the body having a distal end and a proximal end, the inner surface of the body adjacent the proximal end having a diameter larger than an outer diameter of the barrel nut and smaller than a diameter defined by the outer tips of the tines;

the body having a plurality of radially outwardly directed grooves defined in the inner surface and extending longitudinally from the proximal end toward the distal end, the grooves being spaced apart around the periphery of the inner surface so as to correspond with the tines on the barrel nut and allow passage of the tines on the barrel nut therethrough, the grooves defining a longitudinally extending land between each adjacent pair of grooves; and the body further having a circumferentially extending channel defined in the inner surface, spaced from the proximal end so as to receive the tines therein with the barrel nut in the tightened position to allow limited rotation of the body around the barrel relative to the barrel nut.

2. A handguard as claimed in claim 1 wherein the body further includes a plurality of longitudinally extending mounting rails distributed around the outer periphery of the body.

3. A handguard as claimed in claim 2 wherein the plurality of longitudinally extending mounting rails include an upper rail, a lower rail and side rails, one on each side.

4. A handguard as claimed in claim 2 wherein the body further includes a plurality of holes extending therethrough between the plurality of mounting rails.

5. A handguard as claimed in claim 2 wherein the plurality of longitudinally extending mounting rails includes one mounting rail positioned to be axially aligned with a mounting rail on the upper surface of the firearm receiver.

6. A handguard as claimed in claim 1 further including a stop mechanism limiting the rotation of the body to a position in which the tines of the barrel nut are misaligned with the grooves and are aligned with the lands.

7. A handguard as claimed in claim 1 further including a stop mechanism limiting the rotation of the body to a position in which a mounting rail on an upper surface of the body is axially aligned with a mounting rail on the upper surface of the firearm receiver.

8. A handguard as claimed in claim 1 wherein the body further includes a pair of opposed generally arcuate fingers adjacent the proximate end formed and positioned to clamp the handguard to the barrel nut.

9. A handguard as claimed in claim 8 wherein the arcuate fingers further include pressure apparatus clamping the opposed arcuate fingers together to fixedly engage the handguard with the barrel nut.

10. A handguard as claimed in claim 9 wherein the pressure apparatus includes at least one set screw extending through one arcuate finger and threadedly engaged in the other opposed arcuate finger.

11. A handguard for use on a firearm having a receiver, a barrel and a barrel nut affixing the barrel to the receiver, the barrel nut having radially outwardly directed tines spaced about the outer periphery, the handguard comprising:

an elongated tubular, cylindrical body with an inner surface and an outer surface, the body having a distal end and a proximal end, the inner surface of the body adjacent the proximal end having a diameter larger than an outer diameter of the barrel nut and smaller than a diameter defined by the outer tips of the tines;

a plurality of longitudinally extending mounting rails distributed around the outer periphery of the body, the rails being formed to mount auxiliary equipment on the firearm;

the body having a plurality of radially outwardly directed grooves defined in the inner surface and extending longitudinally from the proximal end toward the distal end, the grooves being spaced apart around the periphery of the inner surface so as to correspond with the tines on the barrel nut and allow passage of the tines on the barrel nut therethrough, the grooves defining a longitudinally extending land between each adjacent pair of grooves;

the body further having a circumferentially extending channel defined in the inner surface, spaced from the proximal end so as to receive the tines therein with the barrel nut in the tightened position to allow limited rotation of the body around the barrel relative to the barrel nut; and a pair of opposed generally arcuate fingers associated with the body adjacent the proximate end and pressure apparatus positioned to clamp the opposed arcuate fingers together to fixedly engage the handguard with the barrel nut.

12. A handguard as claimed in claim 11 wherein the pressure apparatus includes at least one set screw extending through one arcuate finger and threadedly engaged in the other opposed arcuate finger.

13. A handguard as claimed in claim 11 wherein a position in which a mounting rail on an upper surface of the body is axially aligned with a mounting rail on the upper surface of the firearm receiver is maintained by the pressure apparatus.

14. A handguard positioned on a firearm, the firearm having a receiver, a barrel and a barrel nut affixing the barrel to the front end of the receiver, the barrel nut having radially outwardly directed tines spaced about the outer periphery, the handguard comprising:

an elongated tubular, cylindrical body with an inner surface and an outer surface, the body having a distal end and a proximal end, the inner surface of the body adjacent the proximal end having a diameter larger than an outer diameter of the barrel nut and smaller than a diameter defined by the outer tips of the tines;

a plurality of longitudinally extending mounting rails distributed around the outer periphery of the body, the rails being formed to mount auxiliary equipment on the firearm;

the body having a plurality of radially outwardly directed grooves defined in the inner surface and extending longitudinally from the proximal end toward the distal end, the grooves being spaced apart around the periphery of the inner surface so as to correspond with the tines on the barrel nut and allow passage of the tines on the barrel nut therethrough, the grooves defining a longitudinally extending land between each adjacent pair of grooves;

the body further having a circumferentially extending channel defined in the inner surface, spaced from the proximal end so as to receive the tines therein with the barrel nut in the tightened position to allow limited rotation of the body around the barrel relative to the barrel nut;

the body substantially coaxially positioned around the barrel with the proximal end adjacent the front end of the firearm receiver and the tines of the barrel nut positioned in the channel and aligned, one each, with the lands between each adjacent pair of grooves and a mounting rail on an upper surface of the body axially aligned with a mounting rail on the upper surface of the firearm receiver; and a pair of opposed generally arcuate fingers associated with the body adjacent the proximate end and pressure apparatus clamping the opposed arcuate fingers together against the barrel nut to fixedly engage the handguard with the barrel nut.

15. A handguard as claimed in claim 14 wherein the pressure apparatus includes at least one set screw extending through one arcuate finger and threadedly engaged in the other opposed arcuate finger.

16. A handguard as claimed in claim 14 wherein the plurality of longitudinally extending mounting rails include an upper rail, a lower rail and side rails, one on each side.

17. A handguard as claimed in claim 14 wherein the body further includes a plurality of holes extending therethrough between the plurality of mounting rails.

18. A method of affixing a handguard to a firearm having a receiver, a barrel and a barrel nut affixing the barrel to the receiver, the barrel nut having radially outwardly directed tines spaced about the outer periphery, the firearm further having a mounting rail extending axially along the upper surface of the receiver, the method comprising the steps of:

providing a handguard having an elongated tubular, cylindrical body with an inner surface and an outer surface, the body having a distal end and a proximal end, the body having a mounting rail extending longitudinally along the upper surface, the inner surface of the body adjacent the proximal end having a diameter larger than an outer diameter of the barrel nut and smaller than a diameter defined by the outer tips of the tines, the body having a plurality of radially outwardly directed grooves defined in the inner surface and extending longitudinally from the proximal end toward the distal end, the grooves being spaced apart around the periphery of the inner surface so as to correspond with the tines on the barrel nut and allow passage of the tines on the barrel nut therethrough, the grooves defining a longitudinally extending land between each adjacent pair of grooves, and the body further having a circumferentially extending channel defined in the inner surface, spaced from the proximal end so as to receive the tines therein with the barrel nut in the tightened position to allow limited rotation of the body around the barrel relative to the barrel nut;

engaging the body of the handguard substantially coaxially over the barrel of the firearm with the proximal end adjacent the front surface of the firearm receiver;

positioning the body of the handguard with the plurality of radially outwardly directed grooves aligned with the tines of the barrel nut and rotationally offset at least one tine so the mounting rail on the upper surface of the body is misaligned at least one tine from the mounting rail on the upper surface of the firearm receiver;

moving the body of the handguard longitudinally to receive the tines of the barrel nut in the grooves far enough to be rotationally aligned with the circumferentially extending channel; and rotating the body of the handguard until the mounting rail on the upper surface of the body is aligned with the mounting rail on the upper surface of the firearm receiver and the tines on the barrel nut are aligned with the lands between each adjacent pair of grooves.

19. A method as claimed in claim 18 wherein the providing step includes providing a pair of opposed generally arcuate fingers associated with the body adjacent the proximate end and pressure apparatus for clamping the opposed arcuate fingers together against the barrel nut and the method includes a step, subsequent to the rotating step, of actuating the pressure apparatus to fixedly engage the handguard with the barrel nut.

20. A method as claimed in claim 19 wherein the step of providing pressure apparatus includes providing at least one set screw extending through one arcuate finger and threadedly engaged in the other opposed arcuate finger and the step of actuating the pressure apparatus includes tightening the set screw.

* * * * *